US009325044B2

(12) United States Patent
Reid

(10) Patent No.: US 9,325,044 B2
(45) Date of Patent: Apr. 26, 2016

(54) MULTI-LAYER DIGITAL ELLIPTIC FILTER AND METHOD

(71) Applicant: James Robert Reid, Billerica, MA (US)

(72) Inventor: James Robert Reid, Billerica, MA (US)

(73) Assignee: Nuvotronics, Inc., Radford, VA (US)

( * ) Notice: Subject to any disclaimer, the term of this patent is extended or adjusted under 35 U.S.C. 154(b) by 2 days.

(21) Appl. No.: 14/161,987

(22) Filed: Jan. 23, 2014

(65) Prior Publication Data

US 2014/0210572 A1 Jul. 31, 2014

Related U.S. Application Data

(60) Provisional application No. 61/757,102, filed on Jan. 26, 2013.

(51) Int. Cl.

| | |
|---|---|
| ***H01P 3/08*** | (2006.01) |
| ***H01P 1/205*** | (2006.01) |
| ***H01P 11/00*** | (2006.01) |

(52) U.S. Cl.

CPC ..... *H01P 1/205* (2013.01); *H01P 1/2053* (2013.01); *H01P 11/00* (2013.01); *Y10T 29/49156* (2015.01)

(58) Field of Classification Search

CPC ..... H01P 1/205; H01P 11/00; H01P 1/2053; Y10T 29/49156

USPC ..... 333/204, 185, 203

See application file for complete search history.

(56) References Cited

U.S. PATENT DOCUMENTS

| | | | |
|---|---|---|---|
| 2,743,505 | A | 5/1956 | Hill |
| 2,812,501 | A | 11/1957 | Sommers |
| 2,914,766 | A | 11/1959 | Butler |
| 2,997,519 | A | 8/1961 | Hines |
| 3,309,632 | A | 3/1967 | Trudeau |
| 3,311,966 | A | 4/1967 | Henry |
| 3,335,489 | A | 8/1967 | Grant |
| 3,352,730 | A | 11/1967 | Murch |
| 3,464,855 | A | 9/1969 | Quintana |
| 3,537,043 | A | 10/1970 | Smith |
| 3,560,896 | A | 2/1971 | Essinger |
| 3,577,105 | A | 5/1971 | Jones |
| 3,598,107 | A | 8/1971 | Ishikawa |
| 3,760,306 | A | 9/1973 | Spinner |
| 3,775,844 | A | 12/1973 | Parks |
| 3,789,129 | A | 1/1974 | Ditscheid |

(Continued)

FOREIGN PATENT DOCUMENTS

| | | | |
|---|---|---|---|
| CA | 2055116 | A1 | 5/1992 |
| DE | 3623093 | A1 | 1/1988 |

(Continued)

OTHER PUBLICATIONS

European Examination Report of EP App. No. 07150463.3 dated Feb. 16, 2015.

(Continued)

*Primary Examiner* — Robert Pascal
*Assistant Examiner* — Kimberly Glenn
(74) *Attorney, Agent, or Firm* — Niels Haun; Dann, Dorfman, Herrell & Skillman, P.C.

(57) ABSTRACT

The present invention relates generally to digital elliptic filters, and more particularly, but not exclusively to multi-layer digital elliptic filters and methods for their fabrication.

10 Claims, 12 Drawing Sheets

(56) References Cited

U.S. PATENT DOCUMENTS

| | | | |
|---|---|---|---|
| 3,791,858 | A | 2/1974 | McPherson |
| 3,884,549 | A | 5/1975 | Wang |
| 3,963,999 | A | 6/1976 | Nakajima |
| 4,021,789 | A | 5/1977 | Furman |
| 4,033,656 | A | 7/1977 | Freehauf |
| 4,075,757 | A | 2/1978 | Malm |
| 4,275,944 | A | 6/1981 | Sochor |
| 4,348,253 | A | 9/1982 | Subbarao |
| 4,365,222 | A | 12/1982 | Lampert |
| 4,414,424 | A | 11/1983 | Mizoguchi |
| 4,417,393 | A | 11/1983 | Becker |
| 4,437,074 | A | 3/1984 | Cohen |
| 4,521,755 | A | 6/1985 | Carlson |
| 4,581,301 | A | 4/1986 | Michaelson |
| 4,591,411 | A | 5/1986 | Reimann |
| 4,641,140 | A | 2/1987 | Heckaman |
| 4,663,497 | A | 5/1987 | Reimann |
| 4,673,904 | A | 6/1987 | Landis |
| 4,700,159 | A | 10/1987 | Jones |
| 4,717,064 | A | 1/1988 | Popielarski |
| 4,771,294 | A | 9/1988 | Wasilousky |
| 4,808,273 | A | 2/1989 | Hua |
| 4,832,461 | A | 5/1989 | Yamagishi |
| 4,853,656 | A | 8/1989 | Guillou |
| 4,856,184 | A | 8/1989 | Doeling |
| 4,857,418 | A | 8/1989 | Schuetz |
| 4,876,322 | A | 10/1989 | Budde |
| 4,880,684 | A | 11/1989 | Boss |
| 4,969,979 | A | 11/1990 | Appelt |
| 4,975,142 | A | 12/1990 | Iannacone |
| 5,069,749 | A | 12/1991 | Gutierrez |
| 5,072,201 | A | 12/1991 | Devaux |
| 5,100,501 | A | 3/1992 | Blumenthal |
| 5,119,049 | A | 6/1992 | Heller |
| 5,191,699 | A | 3/1993 | Ganslmeier |
| 5,227,013 | A | 7/1993 | Kumar |
| 5,235,208 | A | 8/1993 | Katoh |
| 5,274,484 | A | 12/1993 | Mochizuki |
| 5,334,956 | A | 8/1994 | Leding |
| 5,381,157 | A | 1/1995 | Shiga |
| 5,406,235 | A | 4/1995 | Hayashi |
| 5,406,423 | A | 4/1995 | Hayashi |
| 5,430,257 | A | 7/1995 | Lau |
| 5,454,161 | A | 10/1995 | Beilin |
| 5,622,895 | A | 4/1997 | Frank |
| 5,633,615 | A | 5/1997 | Quan |
| 5,682,062 | A | 10/1997 | Gaul |
| 5,682,124 | A | 10/1997 | Suski |
| 5,712,607 | A | 1/1998 | Dittmer |
| 5,724,012 | A | 3/1998 | Teunisse |
| 5,746,868 | A | 5/1998 | Abe |
| 5,793,272 | A | 8/1998 | Burghartz |
| 5,814,889 | A | 9/1998 | Gaul |
| 5,860,812 | A | 1/1999 | Gugliotti |
| 5,872,399 | A | 2/1999 | Lee |
| 5,925,206 | A | 7/1999 | Boyko |
| 5,961,347 | A | 10/1999 | Hsu |
| 5,977,842 | A | 11/1999 | Brown |
| 5,990,768 | A | 11/1999 | Takahashi |
| 6,008,102 | A | 12/1999 | Alford |
| 6,027,630 | A | 2/2000 | Cohen |
| 6,054,252 | A | 4/2000 | Lundy |
| 6,180,261 | B1 | 1/2001 | Inoue |
| 6,207,901 | B1 | 3/2001 | Smith |
| 6,210,221 | B1 | 4/2001 | Maury |
| 6,228,466 | B1 | 5/2001 | Tsukada |
| 6,294,965 | B1 | 9/2001 | Merrill |
| 6,329,605 | B1 | 12/2001 | Beroz |
| 6,350,633 | B1 | 2/2002 | Lin |
| 6,388,198 | B1 | 5/2002 | Bertin |
| 6,457,979 | B1 | 10/2002 | Dove |
| 6,465,747 | B2 | 10/2002 | DiStefano |
| 6,466,112 | B1 | 10/2002 | Kwon |
| 6,514,845 | B1 | 2/2003 | Eng |
| 6,518,165 | B1 | 2/2003 | Yoon |
| 6,535,088 | B1 | 3/2003 | Sherman |
| 6,589,594 | B1 | 7/2003 | Hembree |
| 6,600,395 | B1 | 7/2003 | Handforth |
| 6,603,376 | B1 | 8/2003 | Handforth |
| 6,648,653 | B2 | 11/2003 | Huang |
| 6,662,443 | B2 | 12/2003 | Chou |
| 6,677,248 | B2 | 1/2004 | Kwon |
| 6,735,009 | B2 | 5/2004 | Li |
| 6,746,891 | B2 | 6/2004 | Cunningham |
| 6,749,737 | B2 | 6/2004 | Cheng |
| 6,800,360 | B2 | 10/2004 | Miyanaga |
| 6,800,555 | B2 | 10/2004 | Test |
| 6,827,608 | B2 | 12/2004 | Hall |
| 6,850,084 | B2 | 2/2005 | Hembree |
| 6,888,427 | B2 | 5/2005 | Sinsheimer |
| 6,914,513 | B1 | 7/2005 | Wahlers |
| 6,917,086 | B2 | 7/2005 | Cunningham |
| 6,943,452 | B2 | 9/2005 | Bertin |
| 6,971,913 | B1 | 12/2005 | Chu |
| 6,975,267 | B2 | 12/2005 | Stenger |
| 6,981,414 | B2 | 1/2006 | Knowles |
| 7,005,750 | B2 | 2/2006 | Liu |
| 7,012,489 | B2 | 3/2006 | Sherrer |
| 7,030,712 | B2 | 4/2006 | Brunette |
| 7,064,449 | B2 | 6/2006 | Lin |
| 7,077,697 | B2 | 7/2006 | Kooiman |
| 7,084,722 | B2 | 8/2006 | Goyette |
| D530,674 | S | 10/2006 | Ko |
| 7,129,163 | B2 | 10/2006 | Sherrer |
| 7,148,141 | B2 | 12/2006 | Shim |
| 7,148,722 | B1 | 12/2006 | Cliff |
| 7,148,772 | B2 | 12/2006 | Sherrer |
| 7,165,974 | B2 | 1/2007 | Kooiman |
| 7,217,156 | B2 | 5/2007 | Wang |
| 7,222,420 | B2 | 5/2007 | Moriizumi |
| 7,239,219 | B2 | 7/2007 | Brown |
| 7,252,861 | B2 | 8/2007 | Smalley |
| 7,259,640 | B2 | 8/2007 | Brown |
| 7,400,222 | B2 | 7/2008 | Kwon |
| 7,405,638 | B2 | 7/2008 | Sherrer |
| 7,449,784 | B2 | 11/2008 | Sherrer |
| 7,478,475 | B2 | 1/2009 | Hall |
| 7,508,065 | B2 | 3/2009 | Sherrer |
| 7,532,163 | B2 | 5/2009 | Chang |
| 7,555,309 | B2 | 6/2009 | Baldor |
| 7,575,474 | B1 | 8/2009 | Dodson |
| 7,579,553 | B2 | 8/2009 | Moriizumi |
| 7,602,059 | B2 | 10/2009 | Nobutaka |
| 7,619,441 | B1 | 11/2009 | Rahman |
| 7,645,940 | B2 | 1/2010 | Shepherd |
| 7,649,432 | B2 | 1/2010 | Sherrer |
| 7,656,256 | B2 | 2/2010 | Houck |
| 7,658,831 | B2 | 2/2010 | Mathieu |
| 7,683,842 | B1 | 3/2010 | Engel |
| 7,705,456 | B2 | 4/2010 | Hu |
| 7,755,174 | B2 | 7/2010 | Rollin |
| 7,898,356 | B2 | 3/2011 | Sherrer |
| 7,948,335 | B2 | 5/2011 | Sherrer |
| 8,011,959 | B1 | 9/2011 | Tsai |
| 8,031,037 | B2 | 10/2011 | Sherrer |
| 8,188,932 | B2 | 5/2012 | Worl |
| 8,264,297 | B2 | 9/2012 | Thompson |
| 8,304,666 | B2 | 11/2012 | Ko |
| 8,339,232 | B2 | 12/2012 | Lotfi |
| 8,441,118 | B2 | 5/2013 | Hua |
| 8,522,430 | B2 | 9/2013 | Kacker |
| 8,542,079 | B2 | 9/2013 | Sherrer |
| 8,674,872 | B2 | 3/2014 | Billaud |
| 8,742,874 | B2 | 6/2014 | Sherrer |
| 2002/0075104 | A1 | 6/2002 | Kwon |
| 2003/0029729 | A1 | 2/2003 | Cheng |
| 2003/0052755 | A1 | 3/2003 | Barnes |
| 2003/0117237 | A1 | 6/2003 | Niu |
| 2003/0221968 | A1 | 12/2003 | Cohen |
| 2003/0222738 | A1 | 12/2003 | Brown |
| 2004/0000701 | A1 | 1/2004 | White |
| 2004/0004061 | A1 | 1/2004 | Merdan |
| 2004/0007468 | A1 | 1/2004 | Cohen |
| 2004/0007470 | A1 | 1/2004 | Smalley |

(56) References Cited

U.S. PATENT DOCUMENTS

| | | | |
|---|---|---|---|
| 2004/0038586 | A1 | 2/2004 | Hall |
| 2004/0076806 | A1 | 4/2004 | Miyanaga |
| 2004/0124961 | A1 | 7/2004 | Aoyagi |
| 2004/0196112 | A1 | 10/2004 | Welbon |
| 2004/0263290 | A1 | 12/2004 | Sherrer |
| 2005/0030124 | A1 | 2/2005 | Okamoto |
| 2005/0045484 | A1 | 3/2005 | Smalley |
| 2005/0156693 | A1 | 7/2005 | Dove |
| 2005/0230145 | A1 | 10/2005 | Ishii |
| 2005/0250253 | A1 | 11/2005 | Cheung |
| 2008/0191817 | A1 | 8/2008 | Sherrer |
| 2008/0197946 | A1 | 8/2008 | Houck |
| 2008/0199656 | A1 | 8/2008 | Nichols |
| 2008/0240656 | A1 | 10/2008 | Rollin |
| 2009/0051476 | A1 | 2/2009 | Tada |
| 2009/0154972 | A1 | 6/2009 | Tanaka |
| 2010/0007016 | A1 | 1/2010 | Oppermann |
| 2010/0015850 | A1 | 1/2010 | Stein |
| 2010/0109819 | A1 | 5/2010 | Houck |
| 2010/0225435 | A1 | 9/2010 | Li |
| 2010/0296252 | A1 | 11/2010 | Rollin |
| 2011/0123783 | A1 | 5/2011 | Sherrer |
| 2011/0181376 | A1 | 7/2011 | Vanhille |
| 2011/0181377 | A1 | 7/2011 | Vanhille |
| 2011/0210807 | A1 | 9/2011 | Sherrer |
| 2011/0273241 | A1 | 11/2011 | Sherrer |
| 2013/0050055 | A1 | 2/2013 | Paradiso |
| 2013/0127577 | A1 | 5/2013 | Lotfi |

FOREIGN PATENT DOCUMENTS

| | | | |
|---|---|---|---|
| EP | 0398019 | | 4/1990 |
| EP | 0485831 | A1 | 5/1992 |
| EP | 0845831 | A2 | 6/1998 |
| EP | 0911903 | A2 | 4/1999 |
| FR | 2086327 | | 4/1971 |
| GB | 2265754 | | 10/1993 |
| JP | H027587 | A | 1/1990 |
| JP | 3027587 | | 2/1991 |
| JP | H041710 | A | 1/1992 |
| JP | H0685510 | A | 3/1994 |
| JP | H06302964 | A | 10/1994 |
| JP | H10041710 | | 2/1998 |
| JP | 200667621 | | 3/2006 |
| TW | I244799 | | 12/2005 |
| WO | 0007218 | A2 | 2/2000 |
| WO | 0039854 | A1 | 7/2000 |
| WO | 0206152 | | 1/2002 |
| WO | 0206152 | A2 | 1/2002 |
| WO | 02080279 | A1 | 10/2002 |
| WO | 2004004061 | | 1/2004 |
| WO | 2010111455 | | 9/2010 |

OTHER PUBLICATIONS

Ali Darwish et al.; Vertical Balun and Wilkinson Divider; 2002 IEEE MTT-S Digest; pp. 109-112.

Brown et al., 'A Low-Loss Ka-Band Filter in Rectangular Coax Made by Electrochemical Fabrication', submitted to Microwave and Wireless Components Letters, date unknown {downloaded from www.memgen.com, 2004).

Chance, G.I. et al., "A suspended-membrane balanced frequency doubler at 200GHz," 29th International Conference on Infrared and Millimeter Waves and Terahertz Electronics, pp. 321-322, Karlsrube, 2004.

Chwomnawang et al., 'On-chip 3D Air Core Micro-Inductor for High-Frequency Applications Using Deformation of Sacrificial Polymer', Proc. SPIE, vol. 4334, pp. 54-62, Mar. 2001.

Colantonio, P., et al., "High Efficiency RF and Microwave Solid State Power Amplifiers," pp. 380-395, 2009.

Cole, B.E., et al., Micromachined Pixel Arrays Integrated with CMOS for Infrared Applications, pp. 64-64 (2000).

De Los Santos, H.J., Introduction to Microelectromechanical (MEM) Microwave Systems {pp. 4, 7-8, 13) (1999).

Deyong, C, et al., A Microstructure Semiconductor Thermocouple for Microwave Power Sensors, 1997 Asia Pacific Microwave Conference, pp. 917-919.

Ehsan, N., "Broadband Microwave Litographic 3D Components," Dissertation 2009.

Ehsan, N. et al., "Microcoaxial lines for active hybrid-monolithic circuits," 2009 IEEE MTT-S Int. Microwave.Symp. Boston, MA, Jun. 2009.

Elliott Brown/MEMGen Corporation, 'RF Applications of EFAB Technology', MTT-S IMS 2003, pp. 1-15.

Engelmann et al., 'Fabrication of High Depth-to-Width Aspect Ratio Microstructures', IEEE Micro Electro Mechanical Systems (Feb. 1992), pp. 93-98.

European Examination Report dated Mar. 21, 2013 for EP Application No. 07150463.3.

European Examination Report of corresponding European Patent Application No. 08 15 3144 dated Apr. 6, 2010.

European Examination Report of corresponding European Patent Application No. 08 15 3144 dated Feb. 22, 2012.

European Examination Report of corresponding European Patent Application No. 08 15 3144 dated Nov. 10, 2008.

European Search Report for corresponding EP Application No. 07150463.3 dated Apr. 23, 2012.

European Search Report of Corresponding European Application No. 07 15 0467 mailed Apr. 28, 2008.

European Search Report of corresponding European Application No. 08 15 3138 mailed Jul. 4, 2008.

European Search Report of corresponding European Application No. 08153138.6 mailed Jul. 15, 2008.

European Search Report of corresponding European Patent Application No. 08 15 3144 dated Jul. 2, 2008.

Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.

Filipovic, D.S., "Design of microfabricated rectangular coaxial lines and components for mm-wave applications," Microwave Review, vol. 12, No. 2, Nov. 2006, pp. 11-16.

Filipovic et al.; 'Modeling, Design, Fabrication, and Performance of Rectangular .mu.-Coaxial Lines and Components'; Microwave Symposium Digest, 2006, IEEE; Jun. 1, 2006; pp. 1393-1396.

Franssila, S., Introduction to Microfabrication, (pp. 8) (2004).

Frazier et al., 'M ET ALlic Microstructures Fabricated Using Photosensitive Polyimide Electroplating Molds', Journal of Microelectromechanical Systems, vol. 2, No. 2, Jun. 1993, pp. 87-94.

Ghodisian, B., et al., Fabrication of Affordable M ET ALlic Microstructures by Electroplating and Photoresist Molds, 1996, pp. 68-71.

H. Guckel, 'High-Aspect-Ratio Micromachining Via Deep X-Ray Lithography', Proc. of IEEE, vol. 86, No. 8 (Aug. 1998), pp. 1586-1593.

Hawkins, C.F., The Microelectronics Failure Analysis, Desk Reference Edition (2004).

Immorlica, Jr., T. et al., "Miniature 3D micro-machined solid state power amplifiers," COMCAS 2008.

Ingram, D.L. et al., "A 427 mW 20% compact W-band InP HEMT MMIC power amplifier," IEEE RFIC Symp. Digest 1999, pp. 95-98.

International Preliminary Report on Patentability dated Jul. 24, 2012 for corresponding PCT/US2011/022173.

International Preliminary Report on Patentability dated May 19, 2006 on corresponding PCT/US04/06665.

International Search Report dated Aug. 29, 2005 on corresponding PCT/ US04/06665.

Jeong, I., et al., "High Performance Air-Gap Transmission Lines and Inductors for Milimeter-Wave Applications", Transactions on Microwave Theory and Techniques, vol. 50, No. 12, Dec. 2002.

Jeong, Inho et al., 'High-Performance Air-Gap Transmission Lines and Inductors for Millimeter-Wave Applications', IEEE Transactions on Microwave Theory and Techniques, Dec. 2002, pp. 2850-2855, vol. 50, No. 12.

Katehi et al., 'MEMS and Si Micromachined Circuits for High-Frequency Applications', IEEE Transactions on Microwave Theory and Techniques, vol. 50, No. 3, Mar. 2002, pp. 858-866.

(56) References Cited

OTHER PUBLICATIONS

Kenneth J. Vanhille et al.; Micro-Coaxial Imedance Transformers; Journal of Latex Class Files; vol. 6; No. 1; Jan. 2007.
Kwok, P.Y., et al., Fluid Effects in Vibrating Micromachined Structures, Journal of Microelectromechanical Systems, vol. 14, No. 4, Aug. 2005, pp. 770-781.
Lee et al., 'Micromachining Applications of a High Resolution Ultrathick Photoresist', J. Vac. Sci. Technol. B 13 (6), Nov./Dec. 1995, pp. 3012-3016.
Loechel et al., 'Application of Ultraviolet Depth Lithography for Surface Micromachining', J. Vac. Sci. Technol. B 13 (6), Nov./Dec. 1995, pp. 2934-2939.
Lukic, M. et al., "Surface-micromachined dual Ka-band cavity backed patch antennas," IEEE Trans. AtennasPropag., vol. 55, pp. 2107-2110, Jul. 2007.
Madou, M.J., Fundamentals of Microfabrication: The Science of Miniaturization, 2d Ed., 2002 (Roadmap; pp. 615-668).
Oliver, J.M. et al., "A 3-D micromachined W-band cavity backed patch antenna array with integrated rectacoax transition to wave guide," 2009 Proc. IEEE International Microwave Symposium, Boston, MA 2009.
Park et al., 'Electroplated Micro-Inductors and Micro-Transformers for Wireless application', IMAPS 2002, Denver, CO, Sep. 2002.
PwrSoC Update 2012: Technology, Challenges, and Opportunities for Power Supply on Chip, Presentation (Mar. 18, 2013).
Rollin, J.M. et al., "A membrane planar diode for 200GHz mixing applications," 29th International Conference on Infrared and Millimeter Waves and Terahertz Electronics, pp. 205-206, Karlsrube, 2004.
Rollin, J.M. et al., "Integrated Schottky diode for a sub-harmonic mixer at millimetre wavelengths," 31st International Conference on Infrared and Millimeter Waves and Terahertz Electronics, Paris, 2006.
Saito, Y., Fontaine, D., Rollin, J-M., Filipovic, D., 'Micro-Coaxial Ka-Band Gysel Power Dividers,' Microwave Opt Technol Lett 52: 474-478, Feb. 2010.
Saito et al., "Analysis and design of monolithic rectangular coaxial lines for minimum coupling," IEEE Trans. Microwave Theory Tech., vol. 55, pp. 2521-2530, Dec. 2007.
Sedky, S., Post-Processing Techniques for Integrated MEMS (pp. 9, 11, 164) (2006).
Sherrer, D, Vanhille, K, Rollin, J.M., 'PolyStrata Technology: A Disruptive Approach for 3D Microwave Components and Modules,' Presentation (Apr. 23, 2010).
Tummala et al.; 'Microelectronics Packaging Handbook'; Jan. 1, 1989; XP002477031; pp. 710-714.
Vanhille, K. 'Design and Characterization of Microfabricated Three-Dimensional Millimeter-Wave Components,' Dissertation, 2007.
Vanhille, K. et al., 'Balanced low-loss Ka-band-coaxial hybrids,' IEEE MTT-S Dig., Honolulu, Hawaii, Jun. 2007.
Vanhille, K. et al., "Ka-Band surface mount directional coupler fabricated using micro-rectangular coaxial transmission lines," 2008 Proc. IEEE International Microwave Symposium, 2008.
Vanhille, K.J. et al., "Ka-band miniaturized quasi-planar high-Q resonators," IEEE Trans. Microwave Theory Tech., vol. 55, No. 6, pp. 1272-1279, Jun. 2007.
Vyas R. et al., "Liquid Crystal Polymer (LCP): The ultimate solution for low-cost RF flexible electronics and antennas," Antennas and Propagation Society, International Symposium, p. 1729-1732 (2007).
Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.
Wang, H. et al., "Power-amplifier modules covering 70-113 GHz using MMICs," IEEE Trans Microwave Theory and Tech., vol. 39, pp. 9-16, Jan. 2001.
Written Opinion of the International Searching Authority dated Aug. 29, 2005 on corresponding PCT/US04/06665.
Yeh, J.L., et al., Copper-Encapsulated Silicon Micromachined Structures, Journal of Microelectromechanical Systems, vol. 9, No. 3, Sep. 2000, pp. 281-287.
Yoon et al., '3-D Lithography and M ET AL Surface Micromachining for RF and Microwave MEMS' IEEE MEMS 2002 Conference, Las Vegas, NV, Jan. 2002, pp. 673-676.
Yoon et al., 'CMOS-Compatible Surface Micromachined Suspended-Spiral Inductors for Multi-GHz Sillicon RF lcs', IEEE Electron Device Letters, vol. 23, No. 10, Oct. 2002, pp. 591-593.
Yoon et al., 'High-Performance Electroplated Solenoid-Type Integrated Inductor (SI2) for RF Applications Using Simple 3D Surface Micromachining Technology', Int'l Election Devices Meeting, 1998, San Francisco, CA, Dec. 6-9, 1998, pp. 544-547.
Yoon et al., 'High-Performance Three-Dimensional On-Chip Inductors Fabricated by Novel Micromahining Technology for RF MMIC', 1999 IEEE MTT-S Int'l Microwave Symposium Digest, vol. 4, Jun. 13-19, 1999, Anaheim, California, pp. 1523-1526.
Yoon et al., 'Monolithic High-Q Overhang Inductors Fabricated on Silicon and Glass Substrates', International Electron Devices Meeting, Washington D.C. (Dec. 1999), pp. 753-756.
Yoon et al., 'Monolithic Integration of 3-D Electroplated Microstructures with Unlimited Number of Levels Using Planarization with a Sacrificial M Et ALlic Mole (PSMm)', Twelfth IEEE Int'l Conf. on Micro Electro mechanical systems, Orlando Florida, Jan. 1999, pp. 624-629.
Yoon et al., 'Multilevel Microstructure Fabrication Using Single-Step 3D Photolithography and Single-Step Electroplating', Proc. of SPIE, vol. 3512, (Sep. 1998), pp. 358-366.
Yoon et al., "High-Performance Electroplated Solenoid-Type Integrated Inductor (S12) for RF Applications Using Simple 3D Surface Micromachining Technology", Int'l Election Devices Meeting, 1998, San Francisco, CA, Dec. 6-9, 1998, pp. 544-547.
International Search Report corresponding to PCT/US12/46734 dated Nov. 20, 2012.
Written Opinion corresponding to PCT/US12/46734 dated Nov. 20, 2012.
Horton, M.C., et al., "The Digital Elliptic Filter—A Compact Sharp-Cutoff Design for Wide Bandstop or Bandpass Requirements," IEEE Transactions on Microwave Theory and Techniques, (1967) MTT-15:307-314.
N. Ehsan, K.J. Vanhille, S. Rondineau, Z. Popovic, "Micro-coaxial impedance transformers," IEEE Trans. Microwave Theory Tech., Nov. 2010, pp. 2908-2914.
N. Ehsan, K. Vanhille, S. Rondineau, E. Cullens, Z. Popovic, "Broadband Wilkinson Dividers," IEEE Trans. Microwave Theory Tech., Nov. 2009, pp. 2783-2789.
Y. Saito, J.R. Mruk, J.-M. Rollin, D.S. Filipovic, "X- through Q- band log-periodic antenna with monolithically integrated u-coaxial impedance transformer/feeder," Electronic Letts. Jul. 2009, pp. 775-776.
M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.
M. V. Lukic, and D. S. Filipovic, "Modeling of 3-D Surface Roughness Effects With Application to μ-Coaxial Lines," IEEE Trans. Microwave Theory Tech., Mar. 2007, pp. 518-525.
K. J. Vanhille, D. L. Fontaine, C. Nichols, D. S. Filipovic, and Z. Popovic, "Quasi-planar high-Q millimeter-wave resonators," IEEE Trans. Microwave Theory Tech., vol. 54, No. 6, pp. 2439-2446, Jun. 2006.
M. Lukic, S. Rondineau, Z. Popovic, D. Filipovic, "Modeling of realistic rectangular μ-coaxial lines," IEEE Trans. Microwave Theory Tech., vol. 54, No. 5, pp 2068-2076, May 2006.
H. Zhou, N. A. Sutton, D. S. Filipovic, "W-band endfire log periodic dipole array," Proc. IEEE-APS/URSI Symposium, Spokane, WA, Jul. 2011, pp. 1233-1236.
T.E. Durham, "An 8-40GHz Wideband Instrument for Snow Measurements," Earth Science Technology Forum, Pasadena, CA, Jun. 2011.
J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

(56) References Cited

OTHER PUBLICATIONS

H. Zhou, N. A. Sutton, D. S. Filipovic, "Wideband W-band patch antenna," 5th European Conference on Antennas and Propagation, Rome, Italy, Apr. 2011, pp. 1518-1521.
N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.
E. Cullens, K. Vanhille, Z. Popovic, "Miniature bias-tee networks integrated in microcoaxial lines," in Proc. 40th European Microwave Conf., Paris, France, Sep. 2010, pp. 413-416.
D. Filipovic, G. Potvin, D. Fontaine, Y. Saito, J.-M. Rollin, Z. Popovic, M. Lukic, K. Vanhille, C. Nichols, "μ-coaxial phased arrays for Ka-Band Communications," Antenna Applications Symposium, Monticello, IL, Sep. 2008, pp. 104-115.
J.R. Reid, D. Hanna, R.T. Webster, "A 40/50 GHz diplexer realized with three dimensional copper micromachining," in 2008 IEEE MTT-S Int. Microwave Symp., Atlanta, GA, Jun. 2008, pp. 1271-1274.
A.A. lmmorlica Jr., R. Actis, D. Nair, K. Vanhille, C. Nichols, J.-M. Rollin, D. Fleming, R. Varghese, D. Sherrer, D. Filipovic, E. Cullens, N. Ehsan, and Z. Popovic, "Miniature 3D micromachined solid state amplifiers," in 2008 IEEE International Conference on Microwaves, Communications, Antennas, and Electronic Systems, Tel-Aviv, Israel, May 2008, pp. 1-7.
M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.
M. V. Lukic, and D. S. Filipovic, "Integrated cavity-backed ka-band phased array antenna," Proc. IEEE-APS/URSI Symposium, Jun. 2007, pp. 133-135.
M. Lukic, D. Fontaine, C. Nichols, D. Filipovic, "Surface micromachined Ka-band phased array antenna," Presented at Antenna Applic. Symposium, Monticello, IL, Sep. 2006.
D. Filipovic, Z. Popovic, K. Vanhille, M. Lukic, S. Rondineau, M. Buck, G. Potvin, D. Fontaine, C. Nichols, D. Sherrer, S. Zhou, W. Houck, D. Fleming, E. Daniel, W. Wilkins, V. Sokolov, E. Adler, and J. Evans, "Quasi-planar rectangular ¼-coaxial structures for mm-wave applications," Proc. GomacTech., pp. 28-31, San Diego, Mar. 2006.
M. Lukic, D. Filipovic, "Modeling of surface roughness effects on the performance of rectangular μ-coaxial lines," Proc. 22nd Ann. Rev. Prog. Applied Comp. Electromag. (ACES), pp. 620-625, Miami, Mar. 2006.
J. R. Mruk, N. Sutton, D. S. Filipovic, "Micro-coaxial fed 18 to 110 GHz planar log-periodic antennas with RF transitions,"IEEE Trans. Antennas Propag., vol. 62, No. 2, Feb. 2014, pp. 968-972.
N. Jastram, D. S. Filipovic, "PCB-based prototyping of 3-D micromachined RF subsystems," IEEE Trans. Antennas Propag., vol. 62, No. 1, Jan. 2014. pp. 420-429.
L. Ranzani, D. Kuester, K. J. Vanhille, A Boryssenko, E. Grossman, Z. Popovic, "G-Band micro-fabricated frequency-steered arrays with 2°/GHz beam steering," IEEE Trans. on Terahertz Science and Technology, vol. 3, No. 5, Sep. 2013.
L. Ranzani, E. D. Cullens, D. Kuester, K. J. Vanhille, E. Grossman, Z. Popovic, "W-band micro-fabricated coaxially-fed frequency scanned slot arrays," IEEE Trans. Antennas Propag., vol. 61, No. 4, Apr. 2013.
H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Journal of Solid-State Circuits, Oct. 2012, vol. 47, No. 10, pp. 2327-2334.
N. A. Sutton, J.M. Oliver, D.S. Filipovic, "Wideband 18-40 GHz surface micromachined branchline quadrature hybrid," IEEE Microwave and Wireless Components Letters, Sep. 2012, vol. 22, No. 9, pp. 462-464.
E. Cullens, L. Ranzani, K. Vanhille, E. Grossman, N. Ehsan, Z. Popovic, "Micro-Fabricated 130-180 GHz frequency scanning waveguide arrays," IEEE Trans. Antennas Propag., Aug. 2012, vol. 60, No. 8, pp. 3647-3653.
Mruk, J.R., Filipovic, D.S, "Micro-coaxial V-/W-band filters and contiguous diplexers," Microwaves, Antennas & Propagation, IET, Jul. 17, 2012, vol. 6, issue 10, pp. 1142-1148.
J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.
Mruk, J.R., Saito, Y., Kim, K., Radway, M., Filipovic, D.S., "Directly fed millimetre-wave two-arm spiral antenna," Electronics Letters, Nov. 25, 2010, vol. 46, issue 24, pp. 1585-1587.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Y. Saito, D. Fontaine, J.-M. Rollin, D.S. Filipovic, "Monolithic micro-coaxial power dividers," Electronic Letts., Apr. 2009, pp. 469-470.
D.S. Filipovic, M. Lukic, Y. Lee and D. Fontaine, "Monolithic rectangular coaxial lines and resonators with embedded dielectric support," IEEE Microwave and Wireless Components Letters, vol. 18, No. 11, pp. 740-742, 2008.
D. Sherrer, "Improving electronics\functional density," MICROmanufacturing, May/Jun. 2015, pp. 16-18.
T. Durham, H.P. Marshall, L. Tsang, P. Racette, Q. Bonds, F. Miranda, K. Vanhille, "Wideband sensor technologies for measuring surface snow," Earthzine, Dec. 2013, [online: http://www.earthzine.org/2013/12/02/wideband-sensor-technologies-for-measuring-surface-snow/].
S. Huettner, "High Performance 3D Micro-Coax Technology," Microwave Journal, Nov. 2013. [online: http://www.microwavejournal.com/articles/21004-high-performance-3d-micro-coax-technology].
S. Huettner, "Transmission lines withstand vibration," Microwaves and RF, Mar. 2011. [online: http://mwrf.com/passive-components/transmission-lines-withstand-vibration].
Z. Popovic, S. Rondineau, D. Filipovic, D. Sherrer, C. Nichols, J.-M. Rollin, and K. Vanhille, "An enabling new 3D architecture for microwave components and systems," Microwave Journal, Feb. 2008, pp. 66-86.
"Shiffman phase shifters designed to work over a 15-45GHz range," phys.org, Mar. 2014. [online: http://phys.org/wire-news/156496085/schiffman-phase-shifters-designed-to-work-over-a-15-45ghz-range.html].
B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
T. Liu, F. Houshmand, C. Gorle, S. Scholl, H. Lee, Y. Won, H. Kazemi, K. Vanhille, M. Asheghi, K. Goodson, "Full-Scale Simulation of an Integrated Monolithic Heat Sink for Thermal Management of a High Power Density GaN-SiC Chip," InterPACK/ICNMM, San Francisco, CA, Jul. 2015.
S. Scholl, C. Gorle, F. Houshmand, T. Liu, H. Lee, Y. Won, H. Kazemi, M. Asheghi, K. Goodson, "Numerical Simulation of Advanced Monolithic Microcooler Designs for High Heat Flux Microelectronics," InterPACK, San Francisco, CA, Jul. 2015.
S. Scholl, C. Gorle, F. Houshmand, T. Verstraete, M. Asheghi, K. Goodson, "Optimization of a microchannel geometry for cooling high heat flux microelectronics using numerical methods," InterPACK, San Francisco, CA, Jul. 2015.

(56) References Cited

OTHER PUBLICATIONS

K. Vanhille, T. Durham, W. Stacy, D. Karasiewicz, a. Caba, C. Trent, K. Lambert, F. Miranda, "A microfabricated 8-40 GHz dual-polarized reflector feed," 2014 Antenna Applications Symposium, Monticello, IL, Sep. 2014. pp. 241-257.

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

A. Boryssenko, K. Vanhille, "300-GHz microfabricated waveguide slotted arrays" 2014 IEEE International Conference on Infrared, Millimeter, and Terahertz Waves, Tucson, Sep. 2014.

N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.

L. Ranzani, I. Ramos, Z. Popovic, D. Maksimovic, "Microfabricated transmission-line transformers wit DC isolation," URSI National Radio Science Meeting, Boulder, CO, Jan. 2014.

N. Jastram, D. S. Filipovic, "Parameter study and design of W-band micromachined tapered slot antenna," Proc. IEEE-APS/URSI Symposium, Orlando, FL, Jul. 2013, pp. 434-435.

J.M. Oliver, H. Kazemi, J.-M. Rollin, D. Sherrer, S. Huettner, S. Raman, "Compact, low-loss, micromachined rectangular coaxial millimeter-wave power combining networks," 2013 IEEE MTT-S Int. Microwave, Symp., Seattle, WA, Jun. 2013.

N. Jastram, D. Filipovic, "Monolithically integrated K/Ka array-based direction finding subsystem," Proc. IEEE-APS/URSI Symposium, Chicago, IL, Jul. 2012, pp. 1-2.

N. A. Sutton, D. S. Filipovic, "V-band monolithically integrated four-arm spiral antenna and beamforming network," Proc. IEEE-APS/URSI Symposium, Chicago, IL, Jul. 2012, pp. 1-2.

P. Ralston, K. Vanhille, A. Caba, M. Oliver, S. Raman, "Test and verification of micro coaxial line power performance," 2012 IEEE MTT-S Int. Microwave, Symp., Montreal, Canada, Jun. 2012.

N. A. Sutton, J. M. Oliver, D. S. Filipovic, "Wideband 15-50 GHz symmetric multi-section coupled line quadrature hybrid based on surface micromachining technology," 2012 IEEE Mtt-S Int. Microwave, Symp., Montreal, Canada, Jun. 2012.

J.R. Reid, J.M. Oliver, K. Vanhille, D. Sherrer, "Three dimensional metal micromachining: a disruptive technology for millimeter-wave filters," 2012 IEEE Topical Meeting on Silicon Monolithic Integrated Circuits in RF Systems, Jan. 2012.

P. Ralston, M. Oliver, K. Vummidi, S. Raman, "Liquid-metal vertical interconnects for flip chip assembly of GaAs C-band power amplifiers onto micro-rectangular coaxial transmission lines," IEEE Compound Semiconductor Integrated Circuit Symposium, Oct. 2011.

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

J. R. Mruk, H. Zhou, H. Levitt, D. Filipovic, "Dual wideband monolithically integrated millimeter-wave passive front-end subsystems," in 2010 Int. Conf. on Infrared, Millimeter and Terahertz Waves, Sep. 2010, pp. 1-2.

Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).

L. Ranzani, N. Ehsan, Z. Popovit‡, "G-band frequency-scanned antenna arrays," 2010 IEEE APS-URSI International Symposium, Toronto, Canada, Jul. 2010.

J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.

Z. Popovic, K. Vanhille, N. Ehsan, E. Cullens, Y. Saito, J.-M. Rollin, C. Nichols, D. Sherrer, D. Fontaine, D. Filipovic, "Micro-fabricated micro-coaxial millimeter-wave components," in 2008 Int. Conf. on Infrared, Millimeter and Terahertz Waves, Pasadena, CA, Sep. 2008, pp. 1-3.

K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

K. Vanhille, M. Buck, Z. Popovic, and D.S. Filipovic, "Miniature Ka-band recta-coax components: analysis and design," presented at 2005 AP-S/URSI Symposium, Washington, DC, Jul. 2005.

K. Vanhille, "Design and Characterization of Microfabricated Three-Dimensional Millimeter-Wave Components," Thesis, 2007.

N. Ehsan, "Broadband Microwave Lithographic 3D Components," Thesis, 2009.

J. Oliver, "3D Micromachined Passive Components and Active Circuit Integration for Millimeter-Wave Radar Applications," Thesis, Feb. 10, 2011.

J. Mruk, "Wideband Monolithically Integrated Front-End Subsystems and Components," Thesis, 2011.

E. Cullens, "Microfabricated Broadband Components for Microwave Front Ends," Thesis, 2011.

N. Jastram, "Design of a Wideband Millimeter Wave Micromachined Rotman Lens," IEEE Transactions on Antennas and Propagation, vol. 63, No. 6, Jun. 2015.

N. Jastram, "Wideband Millimeter-Wave Surface Micromachined Tapered Slot Antenna," IEEE Antennas and Wireless Propagation Letters, vol. 13, 2014.

H. Kazemi, "350mW G-band Medium Power Amplifier Fabricated Through a New Method of 3D-Copper Additive Manufacturing," IEEE 2015.

H. Kazemi, "Ultra-compact G-band 16way Power Splitter/Combiner Module Fabricated Through a New Method of 3D-Copper Additive Manufacturing," IEEE 2015.

N. Jastram, "Wideband Multibeam Millimeter Wave Arrays," IEEE 2014.

J. Reid, "PolyStrata Millimeter-wave Tunable Filters," GOMACTech-12, Mar. 22, 2012.

"Multiplexer/LNA Module using PolyStrata®," GOMACTech-15, Mar. 26, 2015.

Extended EP Search Report for EP Application No. 12811132.5 dated Feb. 5, 2016.

MULTI-LAYER DIGITAL ELLIPTIC FILTER AND METHOD

RELATED APPLICATIONS

This application claims the benefit of priority of U.S. Provisional Application No. 61/757,102, filed on Jan. 26, 2013, the entire contents of which application are incorporated herein by reference.

FIELD OF THE INVENTION

The present invention relates generally to digital elliptic filters, and more particularly, but not exclusively to multi-layer digital elliptic filters and methods for their fabrication.

BACKGROUND OF THE INVENTION

While digital elliptic filters have been designed and fabricated, present manufacturable designs include a number of limitations that can inversely impact performance. For example, current digital elliptic filters may be inherently wideband (greater than 30%) and may not be suited to narrowband design due to physical limitations in the design and manufacture of such filters. In addition, the structure of current digital elliptical filters can present manufacturing challenges, because such filters can require a series of internal stubs that must be machined. Still further, the spacing of ground planes may result in junction effects which are difficult to compensate, especially at X-band (8-12 GHz) frequencies and above. Thus, it would be an advance in the art to provide digital elliptic filters having designs that are more readily manufactured at frequencies at or above X-band, as well as providing methods of their manufacture.

SUMMARY OF THE INVENTION

In one of its aspects the present invention may provide a multi-layer digital elliptic filter comprising a conductive enclosure having conductive walls defining a cavity therein. First and second conductive posts may be disposed within the cavity of the conductive enclosure, with conductive posts each having a respective first end connected to a selected conductive wall of the conductive enclosure. In addition, the second conductive post may have a post cavity disposed therein. A conductive stub may be disposed within the post cavity and electrically connected to the first conductive post such that the first and second conductive posts, the conductive stub, and the conductive enclosure have inductive and capacitive properties to provide a digital elliptic filter. The conductive stub may be either partially or fully contained within the post cavity. Moreover, the post cavity may include a longitudinal wall extending along a longitudinal axis of the second post, with a notch disposed in the longitudinal wall. A portion of the stub may be disposed within the notch to provide the electrical connection between the stub and the first conductive post.

In another of its aspects the present invention may provide a method of forming a multi-layer digital elliptic filter by a sequential build process. The method may include depositing a plurality of layers, where the layers comprise one or more of a conductive material and a sacrificial photoresist material, thereby forming a structure which comprises: a conductive enclosure, the enclosure having conductive walls defining a cavity therein; first and second conductive posts disposed within the cavity of the conductive enclosure, the conductive posts each having a respective first end connected to a selected conductive wall of the conductive enclosure, the second conductive post having a post cavity disposed therein; a conductive stub disposed within the post cavity and electrically connected to the first conductive post, wherein the first and second conductive posts, conductive stub, and conductive enclosure are configured to have inductive and capacitive properties to provide a digital elliptic filter. The method may also include removing the sacrificial photoresist. The method of forming a multi-layer digital elliptic filter may include forming a structure, wherein the conductive stub is partially or fully contained within the post cavity. In addition, the method of forming a multi-layer digital elliptic filter may include forming a structure, wherein the post cavity comprises a longitudinal wall extending along a longitudinal axis of the second post, the wall having a notch disposed therein. A portion of the stub may be disposed within the notch to provide the electrical connection between the stub and the first conductive post.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1B:
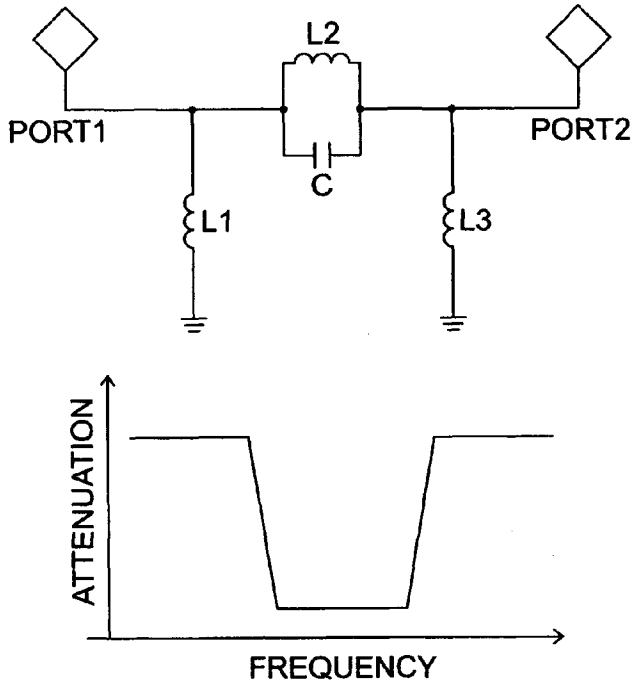
FIG. 1B illustrates a lumped element diagram and high-pass frequency response corresponding to the design of FIG. 1A.
Figure 1A:
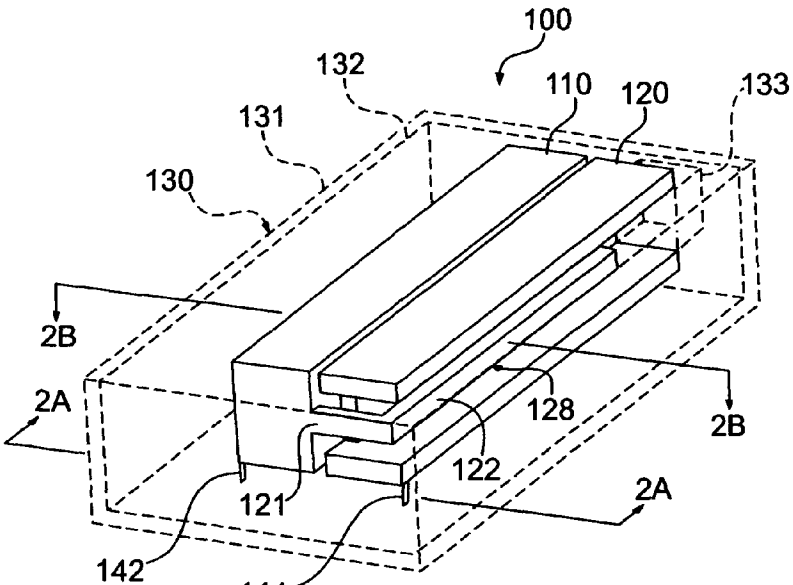
FIG. 1A schematically illustrates an isometric view of an exemplary design of a physical realization of a digital elliptic filter in accordance with the present invention having a post structure (solid lines) enclosed within a metal box (dashed lines)
Figure 1C:
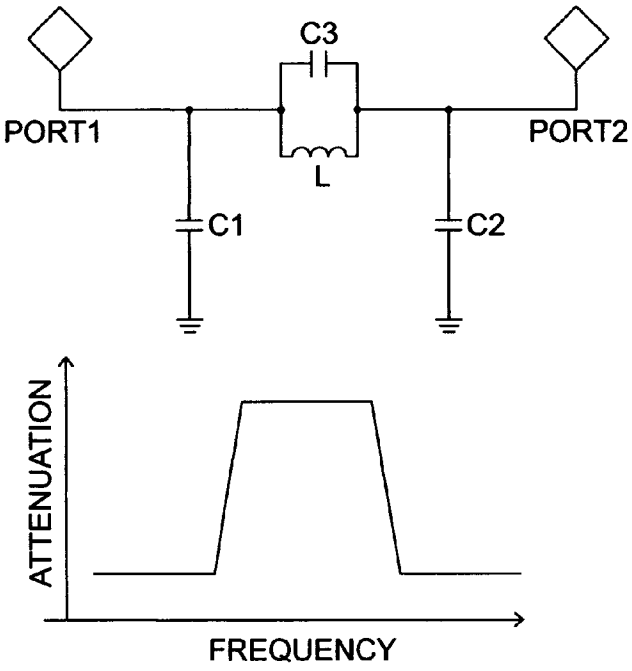
FIG. 1C illustrates a lumped element diagram and frequency response of an alternative design having a band-stop frequency response.
Figure 1D:
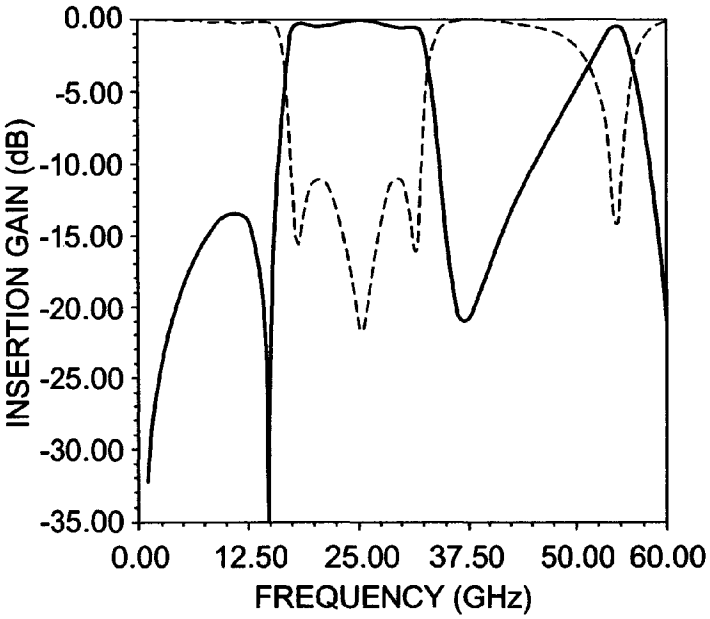
FIG. 1D illustrates the performance of the digital elliptic filter of FIG. 1A, with the solid line showing Insertion Gain in dB (or |S21|) and the dashed line showing return loss in dB (or |S11|)
Figure 2A:
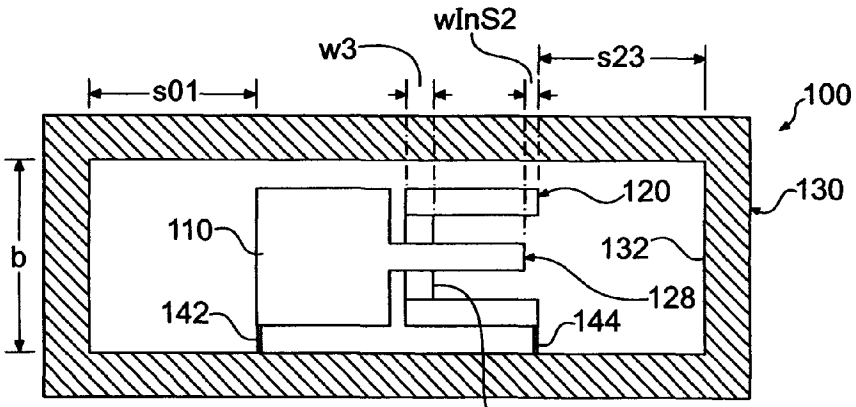
FIG. 2A schematically illustrates a cross-sectional view of the digital elliptic filter and enclosing metal box of FIG. 1A taken along the sectioning line 2A-2A.
Figure 2B:
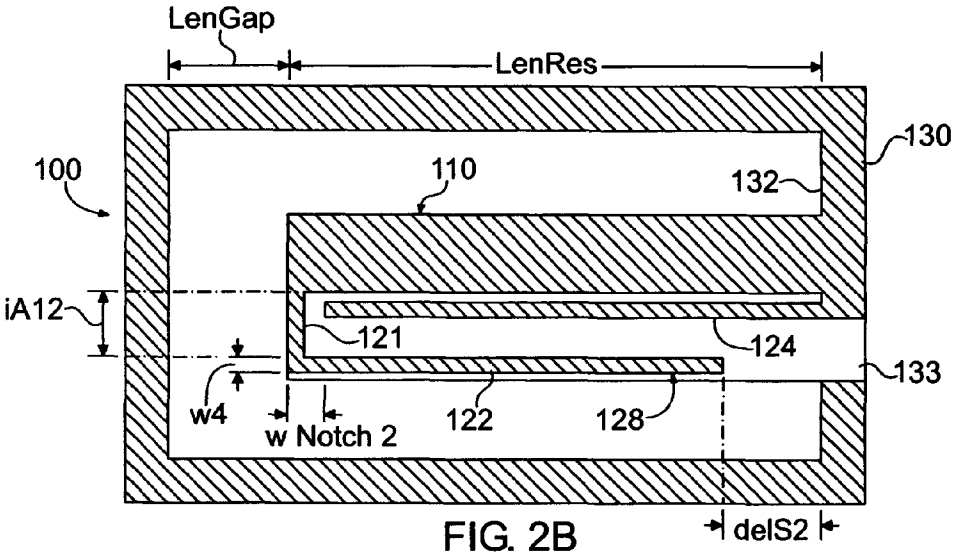
FIG. 2B schematically illustrates a cross-sectional view of the digital elliptic filter and enclosing metal box of FIG. 1A taken along the sectioning line 2B-2B.

Referring now to the figures, wherein like elements are numbered alike throughout, FIG. 1A schematically illustrates an isometric view of an exemplary design of a physical realization of a digital elliptic filter 100 of order n=3 in accordance with the present invention. The filter 100 is a distributed realization of the lumped element circuit having a high pass frequency response as shown in FIG. 1B; the insertion gain performance of the corresponding physical realization of the filter 100 is shown in FIG. 1D. Turning to the specific exemplary physical structure of the filter 100 as illustrated in various views shown in FIGS. 1A, 2A-3D, the filter 100 may include a post structure comprising first and second posts 110, 120 enclosed within and grounded to a hollow (air-filled) metal box 130 having an inner wall 132 and outer wall 131. In addition, idealized 50 ohm ports 142, 144 may be modeled in the design as zero thickness "sheets" to represent where a signal is input/output to/from the filter 100, FIGS. 1A, 2A. In a final physical implementation the idealized ports 142, 144 may be replaced with 50 ohm transmission lines, as illustrated and discussed below in connection with ports 642, 644 of FIGS. 6A-6C, for example.

The first and second posts 110, 120 may have a length (LenRes) that is electrically equivalent to one quarter of a wavelength at which the filter 100 is designed to operate. The first and second posts 110, 120 may be configured to create an electrical response equivalent to an inductor to ground (e.g., L1 and L3, FIG. 1B) as well as an inductive coupling between the posts 110, 120 (e.g., L2, FIG. 1B). The behavior of the first and second posts 110, 120 as inductors, and the values of the inductance of the first and second posts 110, 120, may be determined by the specific configuration of the first and second posts 110, 120 and the metal box 130 relative to one another.

Figure 3A:
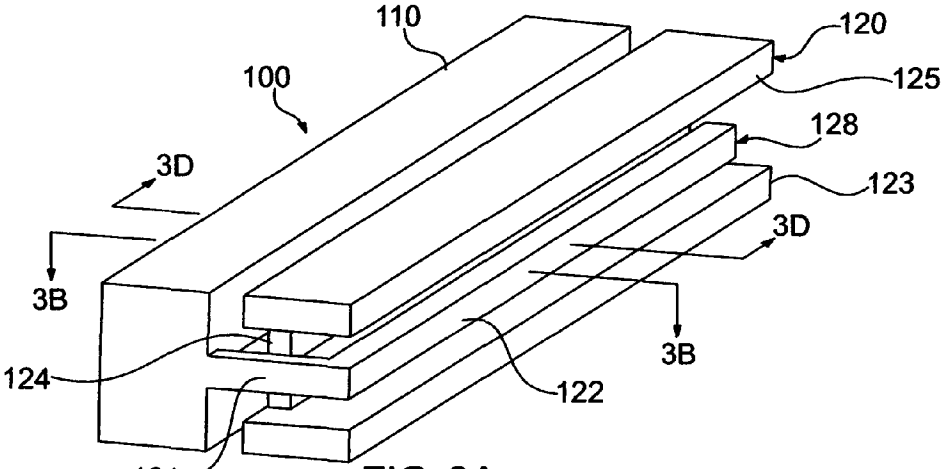
FIG. 3A schematically illustrates the post structure of the digital elliptical filter of FIG. 1A.
Figure 3B:
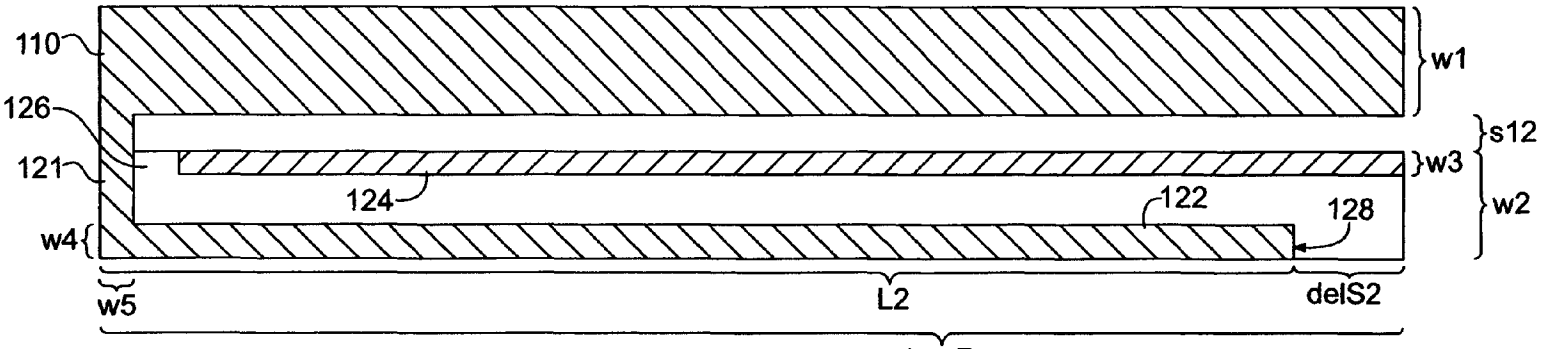
FIG. 3B schematically illustrates a cross-sectional view of the digital elliptical filter portion of FIG. 3A taken along the sectioning lines 3B-3B.
Figure 3D:
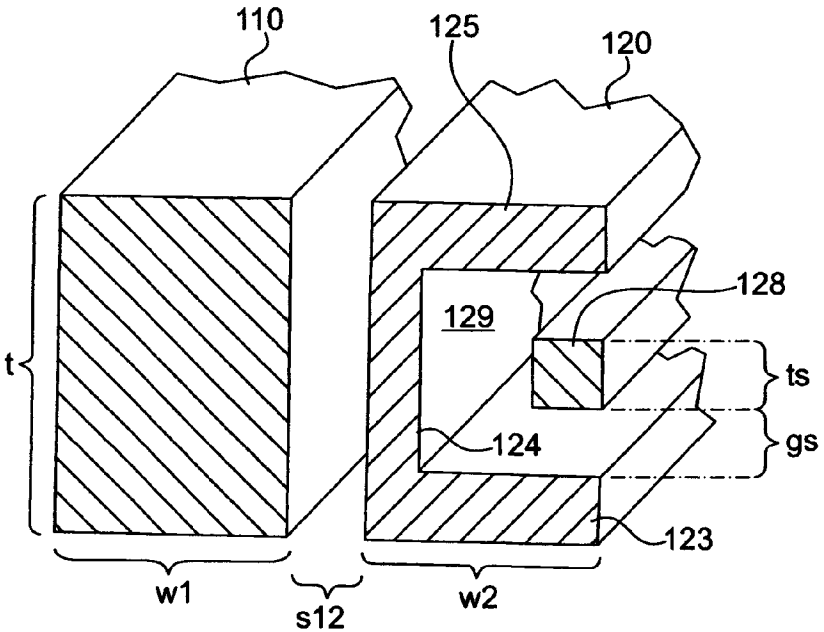
FIG. 3D schematically illustrates a cross-sectional view of the digital elliptical filter portion of FIG. 3A taken along the sectioning lines 3D-3D.
Figure 3C:
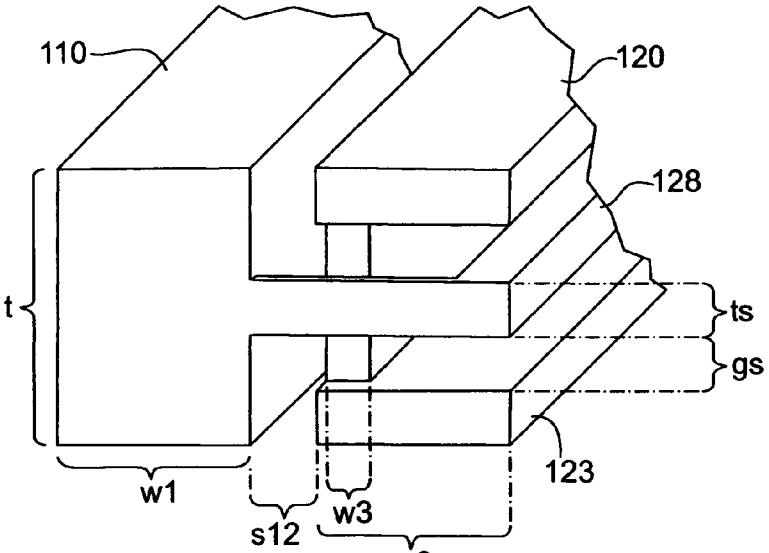
FIG. 3C schematically illustrates an enlarged fragmentary end view of the post structure illustrated in FIG. 3A.

For example, in the exemplary configuration of FIGS. 1A-3D, the first post 110 may be provided in the form of a rectangular solid, and the second post 120 may be provided in the form of a longitudinal post having a C-shaped cross-section taken perpendicular to the longitudinal axis, FIG. 3D. In this regard, the second post 120 may include an upper portion 125 and a lower portion 123 joined by a vertical portion 124 defining a cavity 129 therebetween to provide the C-shape. (The C-shape is depicted with the opening to the right; however, the "C" could be reversed so that the opening in the C-shape of the second post 120 is to the left in FIG. 3D.) An L-shaped stub 128 may be disposed within the cavity 129, where the L-shape is defined by an arm portion 121 and longitudinal portion 122 of the stub 128, FIGS. 1A, 2B-3D. The length of the longitudinal portion 122 may be foreshortened by an amount delS2 to account for the length of the arm portion 121, FIG. 3B. In addition, an opening 133 in the box 130 may optionally be provided to prevent electrical connection between the stub 128 and the box 130. The vertical portion 124 may be foreshortened or notched by providing a notch 126 to permit the stub 128 to be fully enclosed within the second post 120 to deter electrical interaction between the stub 128 and metal box 130. Specifically, the notch 126 may be configured such that the length of the arm portion 121 is minimized to minimize unwanted parasitic circuit elements, in so doing the range of impedances (and thus capacitances) may be increased. The stub 128 may be electrically connected to the first post 110 at the arm portion 121 of the stub 128, FIG. 3B. In this particular exemplary configuration, the C-shaped second post 120 may create a physical element that provides the electrical equivalent of the series capacitor (C) of the equivalent lumped circuit illustrated in FIG. 1B. Hence, the particular physical realization of the digital elliptical filter 100 of FIGS. 1A, 2A-3D provides the performance illustrated in FIG. 1D. In addition, alternative designs in accordance with the present invention are contemplated which would provide physical realizations of a band-stop filter as illustrated in FIG. 1C, which may be accomplished by modifying the configuration of the filter 100 such that the base of the posts 110, 120 are open circuited instead of short circuited, and connecting both ends of the stub 128 to the posts 110, 120.

The design of the physical realization of the digital elliptical filter 100 may be facilitated through the use of suitable modeling software, such as ANSYS HFSS (ANSYS, Inc., Canonsburg, Pa. USA). In addition, a starting point for use with modeling software may be determined using the methodology disclosed in Horton et. al, The digital elliptic filter—a compact sharp cutoff design for wide bandstop or bandpass requirements, IEEE Transactions On Microwave Theory And Techniques, Vol. MTT-I5, No. 5, May 1967, the entire contents of which are incorporated herein by reference.

Design Example

A specific exemplary design of a physical realization of the digital elliptic filter 100 was performed using ANSYS HFSS, which design predicted the performance results illustrated in FIG. 1D. With reference to the dimensioning lines illustrated in FIGS. 1A, 2A-3D, the dimensions of the design are provided in Tables 1 and 2, where Table 1 includes the predefined values and Table 2 the values calculated by the design process. In the design, the thickness of the metal box 130 was not critical from a microwave design point of view, but was set at 0.25 mm on all sidewalls and 0.15 mm on top and bottom surfaces. The length of the posts 110, 120 (LenRes) was calculated to be electrically equal to one quarter of a wavelength at the mid-band frequency of the filter 100. For the design, where the dielectric was essentially air, the mid band length (LenRes) was calculated by the equation $$LenRes = \frac{\lambda}{4} = \frac{v_p}{4 \cdot f_0},$$

where $v_p$ was the phase velocity of a wave propagating along the transmission line and $f_0$ was the center frequency of the filter's passband. For the present design having posts 110, 120 for a TEM (transverse electromagnetic) mode wave with an air dielectric, $v_p$ was equal to the speed of light in a vacuum or $2.998.10^8$ m/s. The center frequency of the filter 100 was 25.0 GHz, making LenRes=2.998 mm. However, the length was then adjusted in simulation to correct for non-ideal effects to provide the value listed in Table 2.

TABLE 1

| Parameter | Value (mm) |
|---|---|
| b | 0.7 |
| t | 0.5 |
| Ts | 0.1 |
| Gs | 0.1 |
| s01 | 0.5 |
| s23 | 0.5 |
| W3 | 0.1 |
| LenGap | 0.75 |

TABLE 2

| Parameter | Value (mm) |
|---|---|
| w1 | 0.47 |
| w2 | 0.47 |
| s12 | 0.06 |
| wInS2 | 0.05 |
| w4 | 0.09 |
| LenRes | 3.20 |
| iA12 | 0.39 |
| delS2 | 0.60 |
| w5 | 0.09 |
| wNotch2 | 0.215 |

Figure 4A:
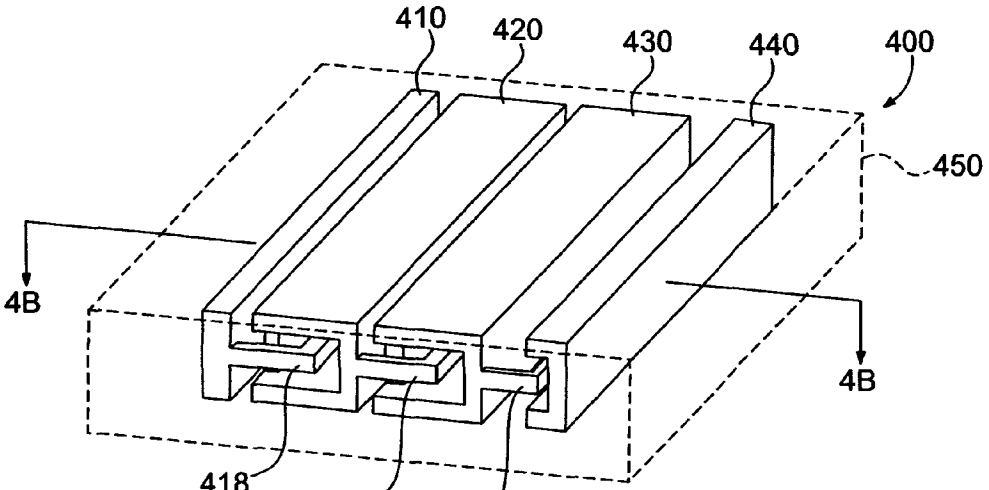
FIG. 4A schematically illustrates an isometric view of a further exemplary design of a physical realization of a digital elliptic filter in accordance with the present invention having a post structure (solid lines) enclosed within a metal box (dashed lines)
Figure 4B:
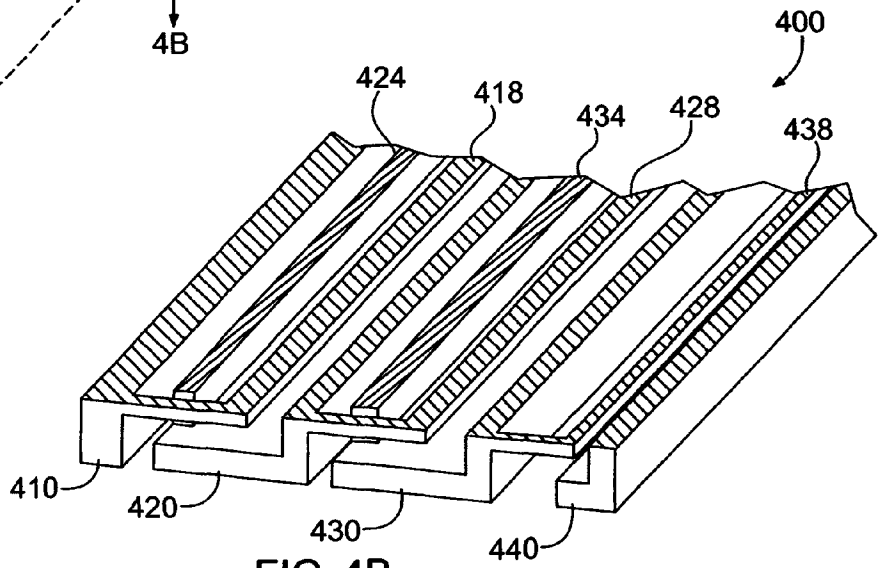
FIG. 4B schematically illustrates a cross-sectional view of the digital elliptic filter of FIG. 4A taken along the sectioning line 4B-4B.
Figure 5:
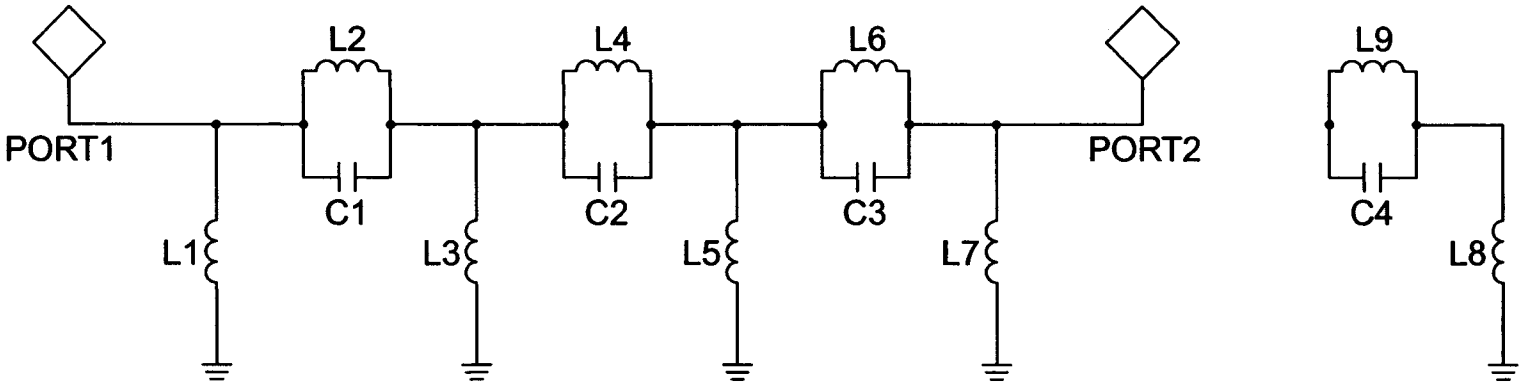
FIG. 5 illustrates a lumped element diagram corresponding to the design of FIGS. 4A-4B.

Leaving the design example and turning to other exemplary configurations of the present invention, FIGS. 4A, 4B schematically illustrate an isometric and cross-sectional views, respectively, of a further exemplary design of a physical realization of a digital elliptic filter 400 where n is extended beyond 3. In particular, the digital elliptic filter 400 represents a specific example where n=7. For odd values of n, extending the digital elliptic filter 400 to include additional elements (of the unit type containing L9/L8 and C4) may be accomplished by adding additional circuit elements as shown in FIG. 5, which physically corresponds to adding additional posts. Thus, the n=7 digital elliptic filter 400 includes four posts 410, 420, 430, 440 with three interposed stubs 418, 428, 438, where the posts 410-440 and stubs 418-438 may be configured and oriented relative to one another in a manner similar to that of the posts 110, 120 and stub 128 of the digital elliptic filter 100. The stubs 418, 428, 438 may be fully or partially enclosed in corresponding posts 420, 430, 440, respectively.

Figure 6A:
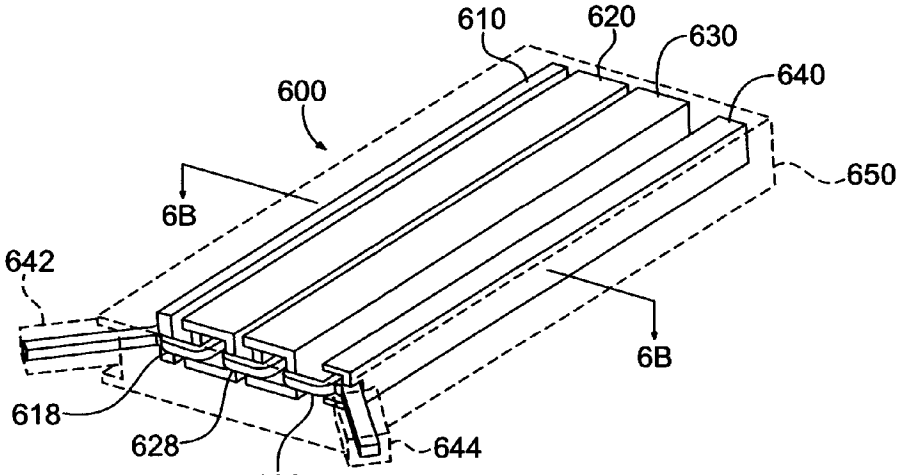
FIG. 6A schematically illustrates an isometric view of another exemplary design of a physical realization of a digital elliptic filter in accordance with the present invention having a post structure (solid lines) enclosed within a metal box (dashed lines) having connecting arms which project out beyond the ends of the posts of the digital elliptic filter.
Figure 6B:
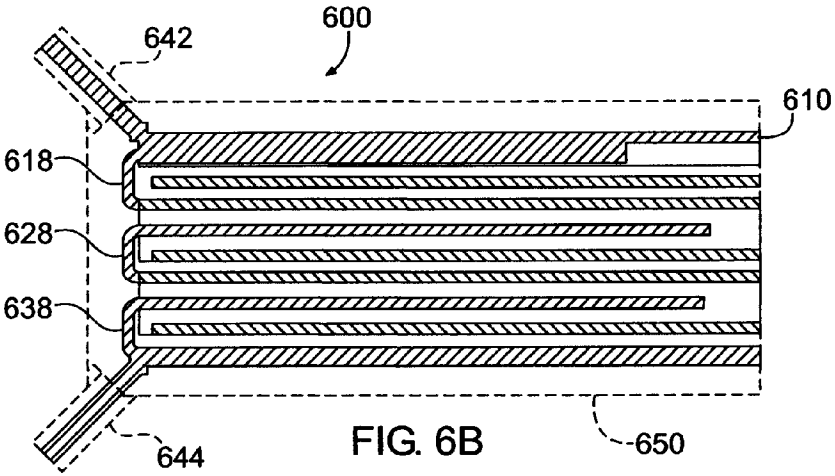
FIG. 6B schematically illustrates a cross-sectional view of the digital elliptical filter of FIG. 6A taken along the sectioning lines 6B-6B.
Figure 6C:
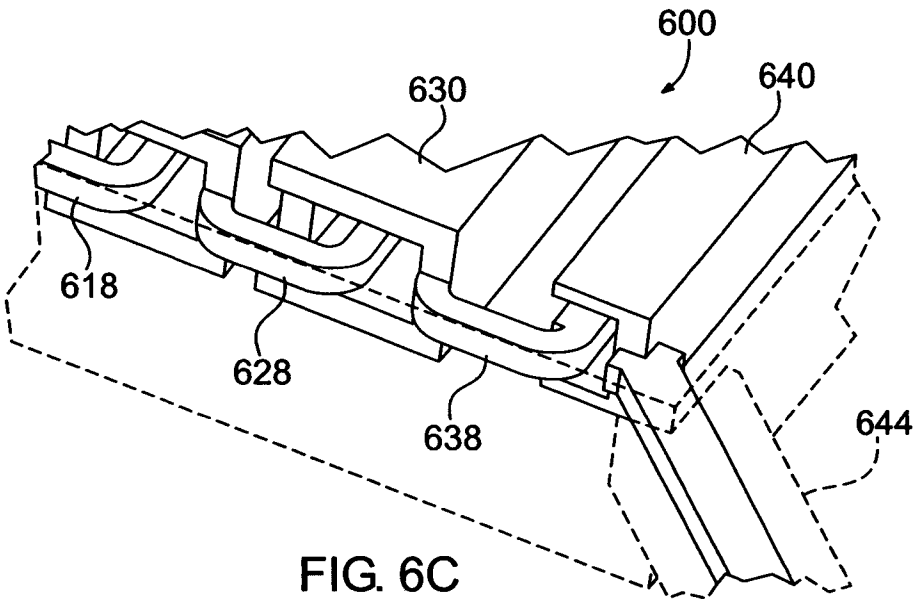
FIG. 6C schematically illustrates an enlarged fragmentary end view of the digital elliptical filter illustrated in FIG. 6A.

In yet another exemplary design of a physical realization of a digital elliptic filter in accordance with the present invention, FIGS. 6A-6C schematically illustrate isometric and cross-sectional views, respectively, of a digital elliptic filter 600. The digital elliptic filter 600 may be similar to the digital elliptic filter 400 by containing four posts 610, 620, 630, 640 and three stubs 618, 628, 638, which may be oriented relative to one another in a similar manner to the correspondingly named parts of the digital elliptic filter 400. However, the digital elliptic filter 600 may differ from the digital elliptic filter 400 in that the stubs 618, 628, 638 may extend outward beyond the ends of the corresponding posts 620, 630, 640 in which the stubs 618, 628, 638 are otherwise enclosed, FIGS. 6B, 6C. In addition, the digital elliptic filter 600 may include input and output ports 642, 644 electrically connected to posts 610, 640, respectively, and grounded to the metal box 650. The two ports 642, 644 may represent a 50 ohm physical transmission line. The ports 642, 644 may connect to posts 610, 640 in-plane with the posts 610, 640 as shown, or may connect to the posts 610, 640 from above or below, or by other suitable orientations, for example.

Figure 7A:
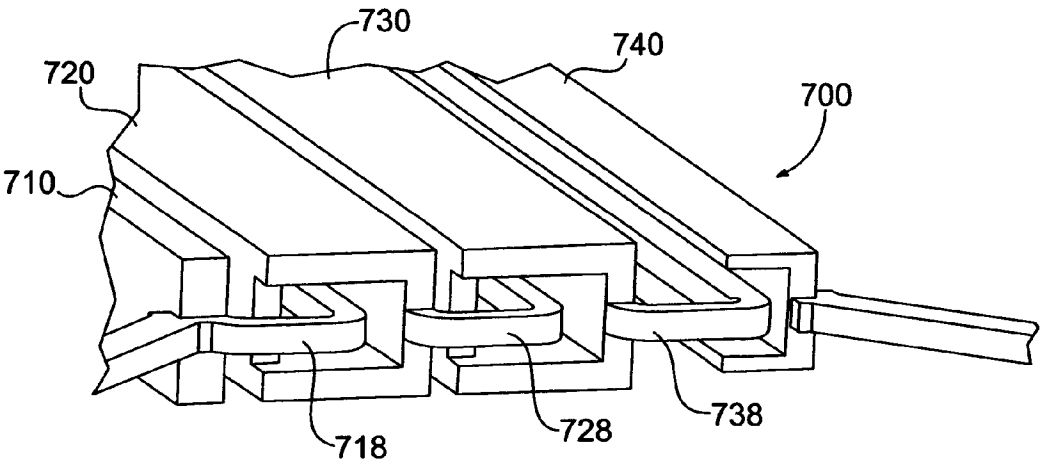
FIGS. 7A, 7B schematically illustrate an isometric and end view, respectively, of yet a further exemplary design of a physical realization of a digital elliptic filter in accordance with the present invention having individual resonators of different height.
Figure 7B:
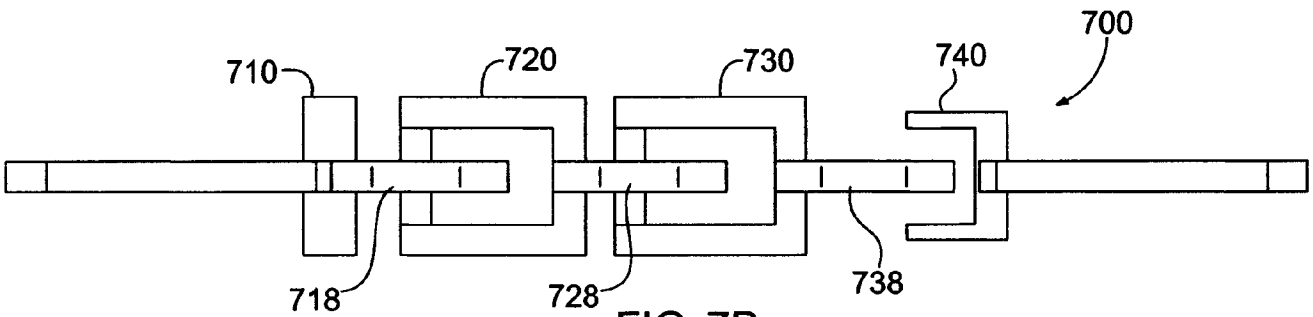

As yet a further exemplary design of a physical realization of a digital elliptic filter in accordance with the present invention, FIGS. 7A, 7B schematically illustrate isometric and end views, respectively, of an exemplary digital elliptic filter 700 in accordance with the present invention having individual resonators of different height. The digital elliptic filter 700 may be similar to the digital elliptic filter 600 as containing four posts 710, 720, 730, 740 and three stubs 718, 728, 738, which may be oriented relative to one another in a similar manner to the correspondingly named parts in the digital elliptic filter 600. However, the digital elliptic filter 700 may differ from the digital elliptic filter 600 in that one or more of the posts, e.g., post 740, may have a height that differs from one or more of the remaining posts 710, 720, 730, FIGS. 7B, 7C. In particular, the decreased height of post 740 permits the post 740 to have increased width, allowing the post 740 to more fully enclose the stub 738 associated therewith.

Figure 8A:
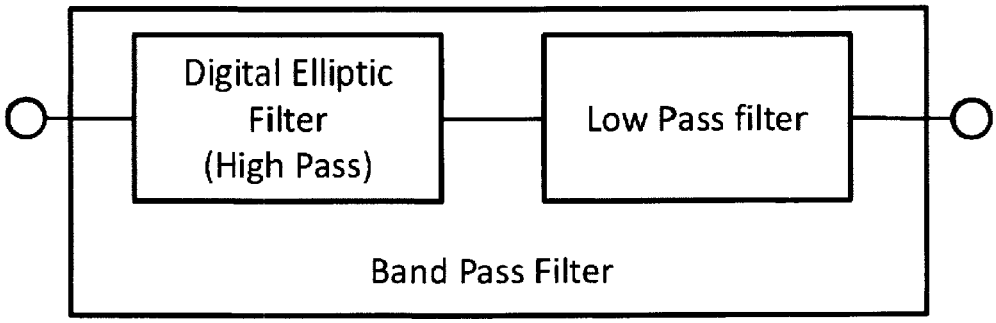
FIGS. 8A-8D schematically illustrate exemplary lumped element diagrams of digital elliptic filters of the present invention used in conjunction with low pass filters.
Figure 8B:
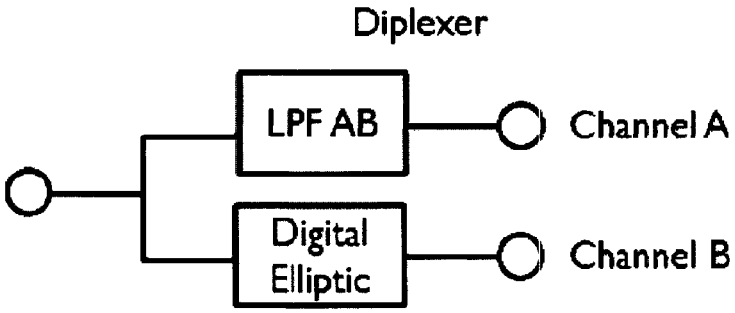
Figure 8C:
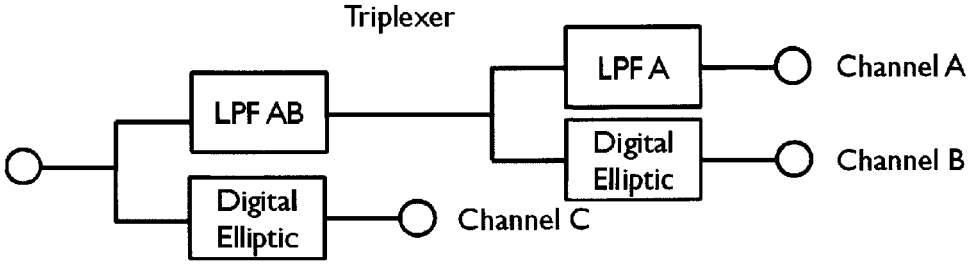
Figure 8D:
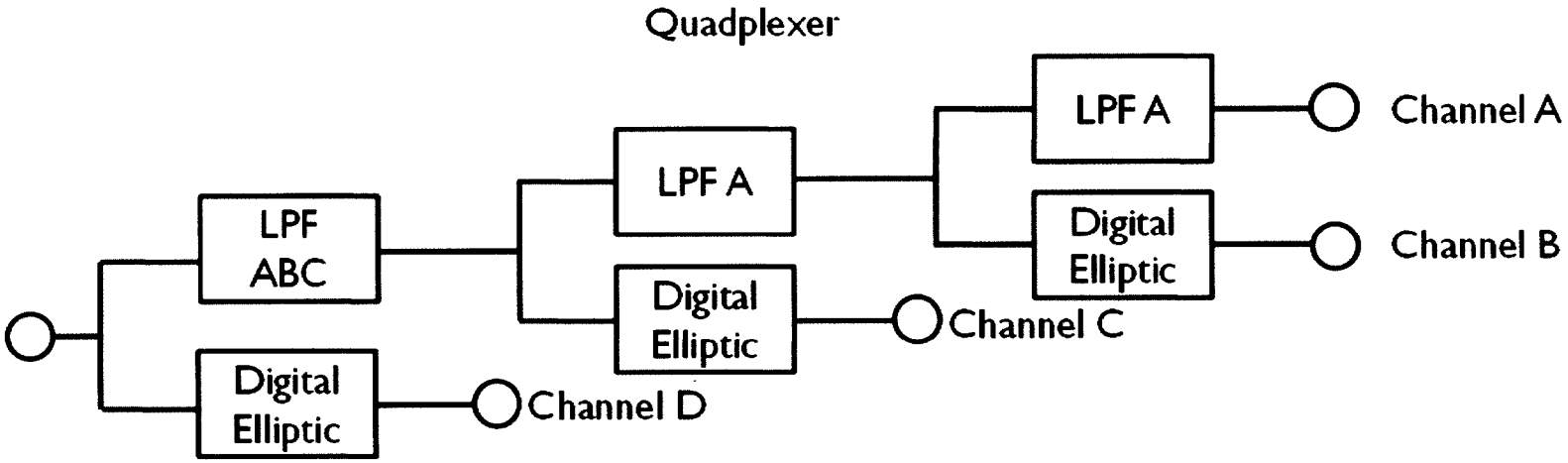

In another of its aspects, digital elliptic filters of the present invention (e.g., filters 100, 400, 600, 700) may be used in conjunction with one or more low pass filters to create a narrow bandwidth bandpass filter, FIGS. 8A-8D. Such a combination can be advantageous in that the size of the digital elliptic filter can be reduced increasing its bandwidth. The low pass filter can then be one of several types, including lumped element, pseudo-lumped element, or stepped impedance. The low pass filter of the stepped impedance type may be particularly useful in that it can be used to route a signal in a manner similar to a transmission line. The digital elliptic filter and low pass filter combination is also well suited to diplexer and multiplexer designs, FIGS. 8B-8D. For instance, the digital elliptic filter may be combined with a low pass filter to create a diplexer, FIG. 8B, and the diplexer can then be cascaded to create a triplexer, quadplexer or higher order n-plexer, FIGS. 8C-8D. In FIGS. 8B-8D the letters signify channels of increasing frequency, such that channel A is the lowest frequency, channel B is higher frequency than A, and so forth.

The exemplary designs of the present invention may be particularly amenable to fabrication by a sequential build process, such as the PolyStrata® process by Nuvotronics, LLC of Radford Va., USA. For instance the metal structures (e.g., posts 110, 120, 410-440, metal boxes 150, 450, and ports 642, 644) may be built up layer by layer by a sequential build process. (The PolyStrata® process is disclosed in U.S. Pat. Nos. 7,012,489, 7,148,772, 7,405,638, 7,948,335, 7,649,432, 7,656,256, 8,031,037, 7,755,174, and 7,898,356, 2008/0199656, 2011/0123783, 2010/0296252, 2011/0273241, 2011/0181376, 2011/0210807, the contents of which patents are incorporated herein by reference.) Thus, in another of its aspects the present invention provides a method of forming a multi-layer digital elliptic filter by a sequential build process.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A multi-layer digital elliptic filter, comprising a conductive enclosure, the enclosure having conductive walls defining a cavity therein, first and second conductive posts disposed within the cavity of the conductive enclosure, the conductive posts each having a respective first end connected to a selected conductive wall of the conductive enclosure, the second conductive post having a post cavity disposed therein, a conductive stub disposed within the post cavity and electrically connected to the first conductive post, wherein the first and second conductive posts, the conductive stub, and the conductive enclosure are configured to have inductive and capacitive properties to provide a digital elliptic filter.

2. The multi-layer digital elliptic filter according to claim 1, wherein the conductive stub is partially contained within the post cavity.

3. The multi-layer digital elliptic filter according to claim 1, wherein the conductive stub is fully contained within the post cavity.

4. The multi-layer digital elliptic filter according to claim 1, wherein the post cavity comprises a longitudinal wall extending along a longitudinal axis of the second post, the wall having a notch disposed therein.

5. The multi-layer digital elliptic filter according to claim 4, wherein a portion of the stub is disposed within the notch to provide an electrical connection between the stub and the first conductive post.

6. A method of forming a multi-layer digital elliptic filter by a sequential build process, comprising depositing a plurality of layers, wherein the layers comprise one or more of a conductive material and a sacrificial photoresist material, thereby forming a structure comprising a conductive enclosure, the enclosure having conductive walls defining a cavity therein, first and second conductive posts disposed within the cavity of the conductive enclosure, the conductive posts each having a respective first end connected to a selected conductive wall of the conductive enclosure, the second conductive post having a post cavity disposed therein, a conductive stub disposed within the post cavity and electrically connected to the first conductive post, wherein the first and second conductive posts, the conductive stub, and the conductive enclosure are configured to have inductive and capacitive properties to provide a digital elliptic filter.

7. The method of forming a multi-layer digital elliptic filter by a sequential build process according to claim 6, wherein the conductive stub is partially contained within the post cavity.

8. The method of forming a multi-layer digital elliptic filter by a sequential build process according to claim 6, wherein the conductive stub is fully contained within the post cavity.

9. The method of forming a multi-layer digital elliptic filter by a sequential build process according to claim 6, wherein the post cavity comprises a longitudinal wall extending along a longitudinal axis of the second post, the wall having a notch disposed therein.

10. The method of forming a multi-layer digital elliptic filter by a sequential build process according to claim 9, wherein a portion of the stub is disposed within the notch to provide an electrical connection between the stub and the first conductive post.

* * * * *